US011799250B2

(12) United States Patent
Fabre et al.

(10) Patent No.: US 11,799,250 B2
(45) Date of Patent: Oct. 24, 2023

(54) PASSIVE DETECTION OF OVERHEATING IN A POWER CONNECTOR

(71) Applicant: APTIV TECHNOLOGIES LIMITED, St. Michael (BB)

(72) Inventors: Jean Fabre, Chartres (FR); Pascal Menard, Villepreux (FR); Mélanie Guillanton, Epernon (FR)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 51 days.

(21) Appl. No.: 17/685,754

(22) Filed: Mar. 3, 2022

(65) Prior Publication Data

US 2022/0285891 A1 Sep. 8, 2022

(30) Foreign Application Priority Data

Mar. 3, 2021 (FR) ..... 2102085

(51) Int. Cl.
*H01R 13/696* (2011.01)
*H01R 13/6581* (2011.01)

(52) U.S. Cl.
CPC ..... *H01R 13/696* (2013.01); *H01R 13/6581* (2013.01)

(58) Field of Classification Search
CPC ..... H01R 13/696; H01R 13/6581
USPC ..... 439/620.26
See application file for complete search history.

(56) References Cited

U.S. PATENT DOCUMENTS 4,075,596 A * 2/1978 Plasko ..... H01H 37/765 337/414
4,356,469 A 10/1982 Dozier
5,574,614 A 11/1996 Busse et al.
10,153,122 B2 * 12/2018 Yoon ..... H01H 85/06
10,566,164 B2 * 2/2020 Sherrima ..... H01H 69/022
2005/0088272 A1 * 4/2005 Yoshikawa ..... H01H 37/765 337/401
2006/0232372 A1 * 10/2006 Yoshikawa ..... H01H 37/767 337/401

(Continued)

FOREIGN PATENT DOCUMENTS

CN 209802529 U 12/2019
CN 209802531 U 12/2019

(Continued)

OTHER PUBLICATIONS

Search Report for French Application No. FR2102085 completed Nov. 30, 2021.

*Primary Examiner* — Peter G Leigh

(74) *Attorney, Agent, or Firm* — Carlson, Gaskey & Olds, P.C.

(57) ABSTRACT

Electrical connector comprising a detection device for detecting potential overheating, which comprises an electrically conductive element and an electrically insulating element inserted between the electrically conductive element and a low-voltage line. The electrically conductive element exerts an elastic force on the insulating element. For example, the electrically conductive element is a spring. In the event of overheating, the insulating element deforms under the pressure of the electrically conductive element and enables an electrical connection between two low-voltage lines. The overheating is detected as a consequence of the electrical design of this connection between the low-voltage lines.

11 Claims, 3 Drawing Sheets

(56) References Cited

U.S. PATENT DOCUMENTS

| | | | | |
|---|---|---|---|---|
| 2009/0179729 | A1* | 7/2009 | Yoshikawa | H01H 37/767<br>337/401 |
| 2016/0336136 | A1* | 11/2016 | Kim | H01H 37/765 |
| 2017/0345603 | A1* | 11/2017 | Yoon | H01H 37/76 |

FOREIGN PATENT DOCUMENTS

| | | | | | |
|---|---|---|---|---|---|
| CN | 111105964 | A | * | 5/2020 | H01H 85/06 |
| CN | 109273894 | B | | 6/2020 | |
| CN | 111854992 | A | | 10/2020 | |
| DE | 2839826 | A1 | * | 3/1979 | H01H 37/765 |
| KR | 20160134492 | A | * | 11/2016 | H01H 37/32 |
| KR | 20180119856 | A | * | 11/2018 | H01H 37/76 |
| WO | 2015083341 | A1 | | 6/2015 | |
| WO | WO-2015163550 | A1 | * | 10/2015 | H01H 37/76 |
| WO | WO-2019054437 | A1 | * | 3/2019 | H01H 37/76 |
| WO | WO-2020080584 | A1 | * | 4/2020 | H01H 37/764 |

* cited by examiner

PASSIVE DETECTION OF OVERHEATING IN A POWER CONNECTOR

CROSS-REFERENCE TO RELATED APPLICATIONS

This application claims priority to French Patent Application No. FR2102085 filed on Mar. 3, 2021.

TECHNICAL FIELD

The invention relates to the field of electrical power connectors for electric or hybrid motor vehicles.

BACKGROUND

Electrical power connectors are used in electric or hybrid motor vehicles, for example to charge batteries from a recharging station, to interconnect a set of batteries to an electric motor, to a power converter, etc.

In hybrid and electric motor vehicles, the electric currents transmitted by the cables and the connectors of the electrical power circuits are relatively high, and may reach 600 amperes, or even more than 1000 amperes at current peaks. Such currents may generate overheating in the connectors.

It is therefore important to be able to limit this risk of overheating and/or to disconnect the supply of power current transmitted by the connector in the event of overheating and/or to provide information that overheating has taken place in order to prompt an inspection of the electrical circuit in which this overheating has occurred.

Solutions involving integrating temperature probes in the connectors are known. Temperature probes, such as thermocouples for example, may be relatively expensive, all the more so since it is necessary to use an electronic circuit to perform and interpret the measurement at the terminals thereof. Other solutions involve integrating in the connector a fuse supplied by a low-voltage current. Temperature probes, such as thermal fuses, have specific shapes that may pose problems in terms of integrating them in a connector. Furthermore, even though the information given by a temperature probe or a fuse indicates that overheating has occurred, this does not necessarily prevent continued use of the connector, which potentially poses a safety problem.

The present disclosure proposes an alternative to the existing solutions.

SUMMARY

To this end, what is proposed is an electrical connector comprising a housing. This housing in particular houses at least one first conductive component configured so as to be integrated in a first low-voltage electrical line and at least one second conductive component configured so as to be integrated in a second low-voltage electrical line. In one exemplary embodiment, described in detail below, the first low-voltage electrical line is configured so as to be electrically linked, connected, to an interlock control circuit of a high-voltage circuit (also called "HVIL" or "high-voltage interlock loop"). Interlock control loops or circuits are used in connectors to detect coupling or decoupling of a connector and a mating connector, and trigger or disconnect the supply of electric power in power contacts housed in the connector and the mating connector. The second low-voltage electrical line may comprise for example one or more shielding elements. In this case, the second conductive component may be a shielding element attached to the housing, such as a shielding metal sheet assembled to the housing. The shielding element makes it possible to at least partially screen the electromagnetic waves produced by the flow of high currents in the cables and the contacts housed in the connector housing. The shielding element is in electrical continuity firstly with the shielding braid of each cable and/or with a shielding sheath surrounding multiple cables, and secondly with the shielding of a mating connector and/or a conductive wall on which the connector is installed.

The solution involving using a low-voltage line already provided for another function (interlock circuit or shielding) makes it possible to provide a function of detecting potential overheating in a power connector, without notably complicating the manufacture and the installation of such a connector, since this does not require adding in particular contacts and/or electrical wires dedicated to this detection.

The first conductive component may be an electrical contact, an electrical contact blade, a shunt, a spring or any other element configured so as to be connected, linked or integrated electrically to or in the first low-voltage line.

The electrical connector furthermore comprises at least one electrically insulating element and at least one electrically conductive element, inserted between the first conductive component and the second conductive component. In other words, the electrically insulating element may be inserted either between the electrically conductive element and the first conductive component, or between the electrically conductive element and the second conductive component, or both between the electrically conductive element and the first conductive component on one side, and between the electrically conductive element and the second conductive component on another side. The insulating element consists of a material having a melting temperature less than or equal to the melting temperature of at least one of the materials forming the housing. For example, the insulating element consists of a material having a melting temperature of between 125° C. and 200° C. The insulating element may possibly also be characterized by a glass transition temperature or any other property that takes account of its ability to deform under the combined effect of a temperature and a mechanical stress.

Specifically, the electrically conductive element exerts an elastic force on the insulating element that is suitable for deforming the electrically insulating element, when the electrically insulating element reaches a given temperature, for example a temperature greater than or equal to its melting temperature. Following this deformation, the electrically conductive element establishes an electrical connection between the first conductive component and the second conductive component. This results for example in a short circuit between the first and second low-voltage lines, which may for example be reflected by grounding of the first low-voltage line, etc.

Thus, if excessive overheating occurs in the connector, the insulating element softens, or even melts at least locally, and the electrically conductive element that exerts a pressure on the insulating element deforms it until electrical contact is established with the first conductive component, on the one hand, and the second conductive component, on the other hand, thus creating an electrical link between them. This results in a modification of the voltage on the first low-voltage line and/or the second low-voltage line. This modification constitutes a signal that makes it possible to detect the overheating. Following this detection, the information may be displayed on the dashboard of the vehicle in order to signal that the vehicle should be taken for repair and to change the detection device comprising the insulating element that has melted, and the power current flowing through the conductor can, as an alternative or in addition, possibly be interrupted.

In any case, it may be advantageous for the modification that occurs between the first and second low-voltage lines in the event of overheating to take the connection assembly, or at least the connector or the mating connector, out of service. For example, when one of the low-voltage lines is connected to an interlock control circuit, grounding this line renders this circuit inoperative, without thereby implementing any electrical signal processing operation. In other words, the taking of the connection assembly, the connector or the mating connector out of service in this case does not result from any calculation or from the processing of a signal; it is the direct consequence of the material event (short circuit or grounding) resulting from the overheating that led to the deformation of the electrically insulating element. It will be noted that, in the same way as overheating is a critical event that risks damaging a connector housing made of plastic, overheating is at the origin of the deformation of the electrically insulating element. In other words, it is the same phenomenon that is used to detect overheating as that which is at the origin of the problem that it is desired to avoid. This therefore gives a consistent and reliable overheating detection method.

Furthermore, the deformation of the electrically insulating element is an irreversible event that requires all or part of the connection assembly in which it is placed to be replaced. This represents an advantage on a safety level.

The material of the electrically insulating element is therefore chosen according to its melting temperature, which defines the acceptable limit for the connector, the mating connector, the connection assembly or else components thereof or neighbours thereof.

This connector also possibly comprises one and/or the other of the following features, each considered independently of one another or in combination with one or more others:

- the first conductive component is configured so as to be connected to an interlock control circuit of a high-voltage circuit by way of the first low-voltage line;
- the second conductive component is a shielding element attached to the housing;
- the insulating element and the electrically conductive element are integrated together in a passive detection device installed in a recess of the housing;
- in the absence of overheating, the electrically conductive element is in contact either with the conductive component or with the shielding element;
- the electrically conductive element exerts a force of between 1 and 50 newtons on the electrically insulating element;
- the electrically conductive element is a helical spring compressed between the electrically insulating element, on the one hand, and the first conductive component or the shielding element, on the other hand.

According to another aspect, what is proposed is a connection assembly comprising a connector as mentioned above, and a mating connector comprising a housing that houses signal contacts that are configured so as to be integrated in the first low-voltage line. These contacts are connected to the first conductive component when the connector and the mating connector are coupled.

According to yet another aspect, what is proposed is a method for detecting overheating in an electrical connection assembly, wherein the deformation of an electrically insulating element made of plastic, under stress from an electrically conductive element, is used to modify an electrical circuit.

For example, this method comprises an operation of collecting a signal by taking a series of electrical measurements on a first low-voltage line. This method furthermore comprises an operation of monitoring, over time, whether the signal collected in the course of the series of electrical measurements taken on the first low-voltage line undergoes a variation following a connection of the first low-voltage line to a second low-voltage line, this connection being the consequence of the deformation of the electrically insulating element.

The method possibly comprises an operation in which a first conductive component is connected to an interlock control circuit of a high-voltage circuit and the variation of the signal occurs following a connection of the first conductive component to a shielding element of the connector, by way of the electrically conductive element.

BRIEF DESCRIPTION OF THE DRAWINGS

Other features and advantages of the invention will become apparent on reading the following detailed description, and from the appended drawings. In these drawings.

DETAILED DESCRIPTION

Figure 1:
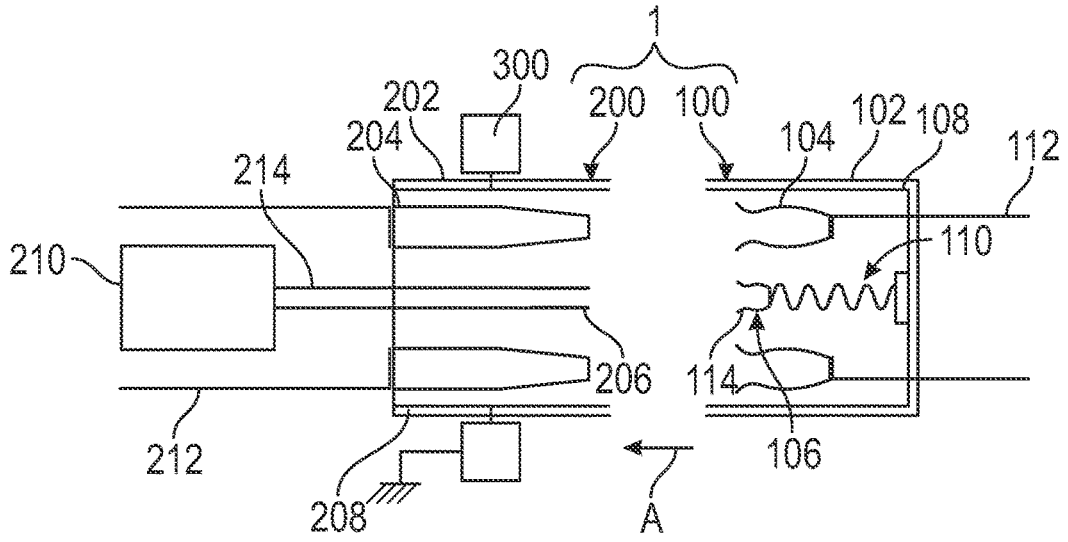
FIG. 1 schematically shows one exemplary embodiment of a connection assembly comprising a connector and a mating connector, before the connector and the mating connector are coupled.

One example of a connection assembly 1 is shown schematically in FIG. 1. This connection assembly comprises a connector 100 configured so as to be coupled to a mating connector 200, parallel to a coupling direction A.

The connector 100 is a cable connector. The mating connector 200 is a receptacle configured so as to be installed on a wall 300 through which it passes. According to this example, the connector 100 is a female connector and the mating connector 200 is a male connector.

The connector 100 comprises in particular a housing 102, power contacts 104, a conductive component 106, a shielding element such as a shielding cage 108 and a passive detection device 110 for passively detecting potential overheating.

The housing 102 of the connector 100 is formed of one or more elements made of insulating plastic. The power contacts 104 are housed in chambers formed in the housing 102. These are female power contacts that are each respectively electrically connected to a cable 112. In this example, the conductive component 106 is an electrical contact blade with two flexible contact tabs 114 that are electrically connected to one another so as to form a shunt. The shielding cage 108 consists of one or more metal sheets made of electrically conductive material. The shielding cage 108 is configured so as to at least partially screen the electromagnetic waves generated by the flow of high currents through the connection assembly 1. The shielding cage 108 is in electrical contact with the individual shielding braids of the cables 112 (and/or with a shielding sheath common to multiple cables 112, this configuration not being shown).

The mating connector 200 comprises in particular a housing 202, power contacts 204, signal contacts 206 and a shielding element such as a shielding cage 208.

The housing 202 of the mating connector 200 is formed of one or more elements made of insulating plastic. The power contacts 204 are housed in chambers formed in the housing 202. These are male power contacts that are each respectively electrically connected to a cable 212. The signal contacts 206, of which there are two, are each respectively connected to an interlock control circuit 210 by electrical wires 214. The signal contacts 206 and the electrical wires 214 are therefore integrated in a first low-voltage electrical line. The interlock control circuit 210 controls the opening and the closure of the high-voltage circuit comprising the power contacts 204 of the mating connector 200.

The shielding cage 208 consists of one or more metal sheets made of electrically conductive material. The shielding cage 208 is configured so as to at least partially screen the electromagnetic waves generated by the flow of high currents through the connection assembly 1. The shielding cage is in electrical contact with the individual shielding braids of the cables 212 (and/or with a shielding sheath common to multiple cables 112, this configuration not being shown). The shielding cage 208 is also in electrical contact with the wall 300, which is itself connected to the ground of the vehicle.

The shielding cages 108, 208 are therefore intended to participate in a second low-voltage electrical line connected to the ground of the vehicle. As an alternative, the shielding cages 108, 208 are integrated in a low-voltage electrical line that is not connected to the ground of the vehicle.

When the connector 100 and mating connector 200 are coupled, the male power contacts 204 and female power contacts 104 are connected in pairs, the signal contacts 206 are connected to the conductive component 106, thereby closing the loop of the interlock control circuit 210, and the respective shielding cages 108, 208 of the connector 100 and mating connector 200 are in electrical contact with one another (thereby also potentially making it possible to connect the cage of the connector to the ground of the vehicle).

Figure 2:
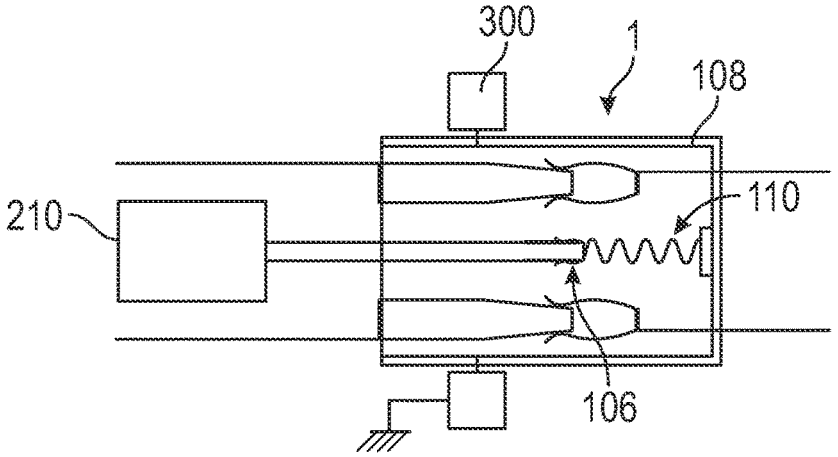
FIG. 2 schematically shows the connection assembly shown in FIG. 1 after the connector and the mating connector have been coupled.

When the connector 100 and mating connector 200 are coupled, the interlock control circuit 210 controls and triggers the supply of power to the power contacts 204 (FIG. 2). Without overheating, the detection device 110 electrically insulates the conductive component 106 from the shielding cage 108 of the connector 100. The first and second low-voltage electrical lines are isolated from one another.

Figure 3:
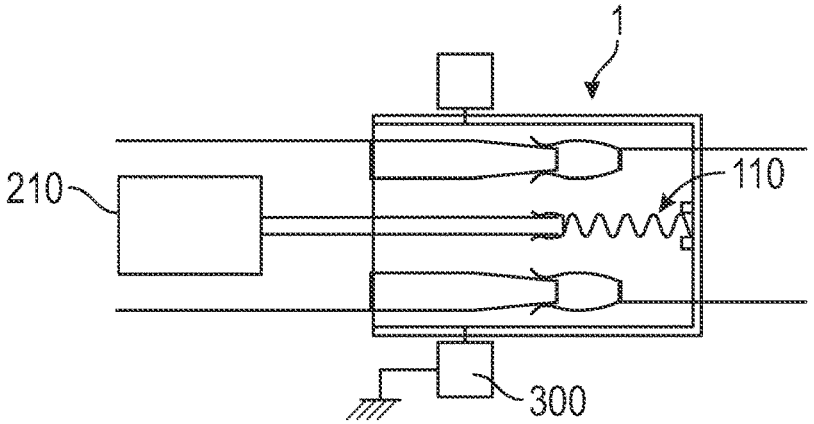
FIG. 3 schematically shows the connection assembly shown in FIG. 1 after the connector and the mating connector have been coupled and after deformation of a passive detection device for detecting overheating.

In the event of overheating of the connector 100 and/or the mating connector 200, the detection device 110 deforms and connects the conductive component 106 to the shielding cage 108 of the connector 100 (FIG. 3). The interlock control circuit 210 detects a variation in the signal measured on the loop of the interlock control circuit 210. For example, before overheating, the interlock control circuit 210 continuously measures a voltage that corresponds to a resistance R, representing the resistance of the electrical wires 214, of the signal contacts 206 and of the conductive component 106, and the contact resistances between these various elements. After overheating, the interlock control circuit 210 measures a voltage that corresponds to a resistance R', representing the resistance of one of the electrical wires 214, of one of the signal contacts 206, of part of the conductive component 106 and of the detection device 110, and the contact resistances between these various elements. The variation between R and R' is enough to signal a change of configuration in the detection device 110, this change resulting from overheating in the connection assembly 1. As an alternative, grounding the interlock control circuit renders it inoperative, thereby possibly causing the disconnection of the supply of power to the power contacts 104, 204.

Figure 4:
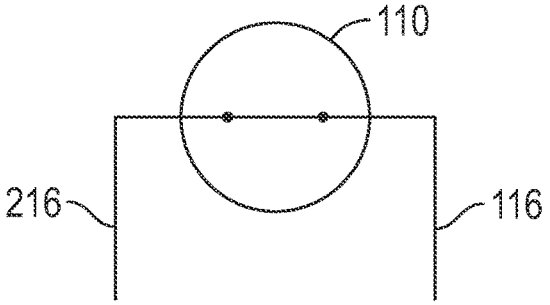
FIG. 4 schematically shows, from an electrical viewpoint, the state of the passive detection device for passively detecting overheating, before overheating.
Figure 5:
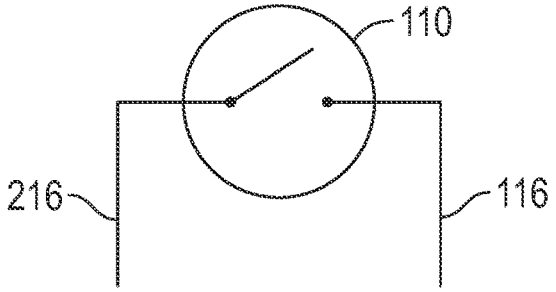
FIG. 5 schematically shows, from an electrical viewpoint, the state of the passive detection device for passively detecting overheating, after overheating.
Figure 6:
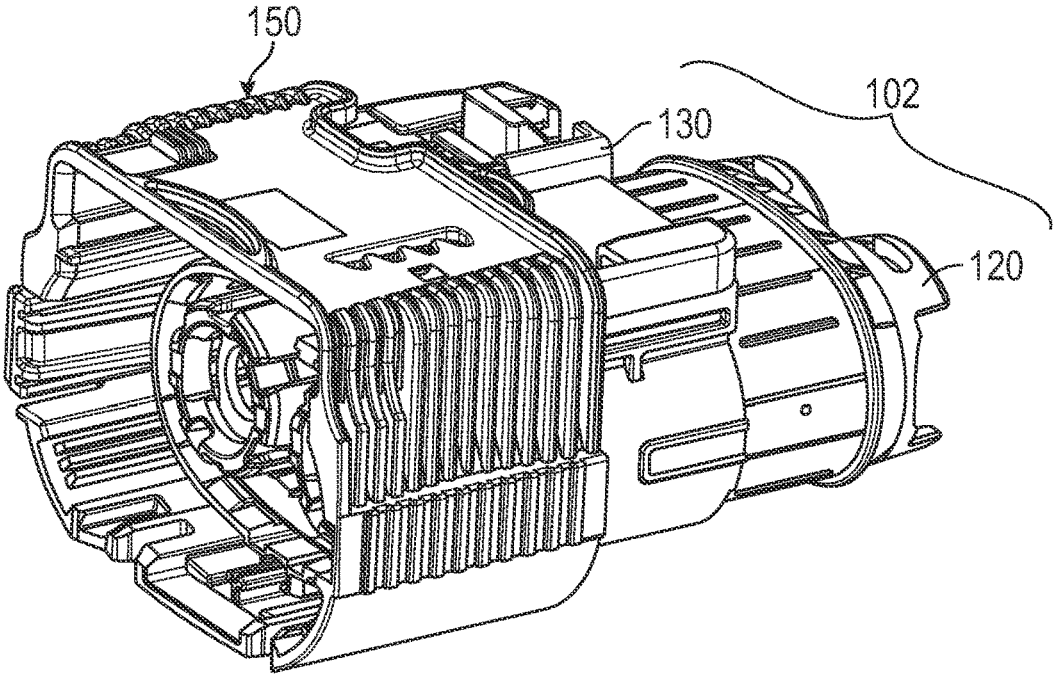
FIG. 6 schematically shows, in perspective, an example of one embodiment of a connector equipped with a passive detection device for detecting overheating.
Figure 7:
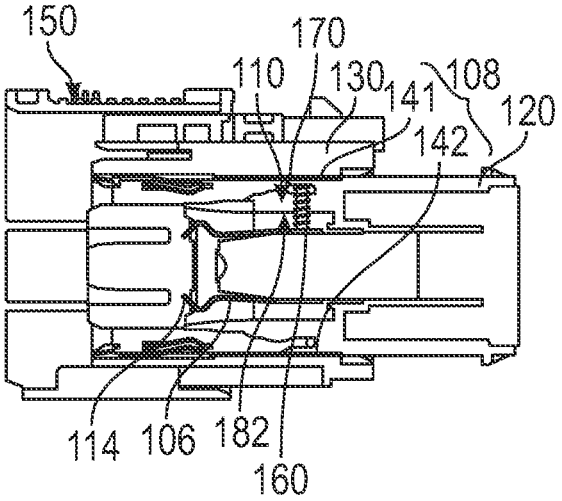
FIG. 7 schematically shows a sectional view of the connector from FIG. 6.

The change of configuration of the detection device 110 is shown schematically in FIGS. 4 and 5. In FIG. 4, before overheating, there is no connection (practically infinite resistance in the detection device 110) between the second low-voltage electrical line 216 of the interlock control circuit 210 and the line 116 incorporating the shielding cage 108 (the first low-voltage electrical line 116 and second low-voltage electrical line 216 are isolated from one another). In FIG. 5, after overheating, the detection device 110 connects the second low-voltage electrical line 216 of the interlock control circuit 210 and the line 116 incorporating the shielding cage 108 (the first low-voltage electrical line 116 and second low-voltage electrical line 216 are connected to one another).

One particular exemplary embodiment of a connector 100 is described with reference to FIGS. 6 to 9 (FIG. 1).

According to this example, the connector 100 comprises an internal housing element 120, an external housing element 130, two shielding metal sheets 141, 142 forming the shielding cage 108, a conductive component 106, a detection device 110, and a coupling assistance device 150.

The shielding metal sheets 141, 142 are inserted between the internal housing element 120 and external housing element 130.

Figure 8:
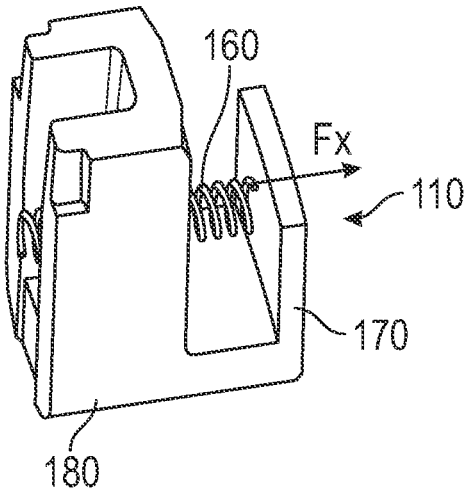
FIG. 8 schematically shows, in perspective, one exemplary embodiment of a passive detection device for detecting overheating, as may be installed in a connector such as the one from FIG. 6.

The detection device 110 comprises an electrically conductive element 160 and an electrically insulating element 170 (FIG. 8). The electrically conductive element 160 is a helical spring. The axial force Fx supplied by the electrically conductive element 160 is for example between 1 and 50 newtons. The electrically conductive element 160 is installed in a support 180. In the exemplary embodiment shown in FIG. 8, the support 180 is integral with the electrically insulating element 170, and consists of a material having a melting temperature of between 125° C. and 200° C. For example, said melting temperature is equal to or close to 180° C. For example, this polymer material is a polypropylene, a polyethylene or an epoxy.

The support 180 and the electrically insulating element 170 form one part having a U-shaped cross section. One of the branches of the U comprises an opening 182 for the passage of the electrically conductive element 160 (see FIG. 7). The other branch of the U corresponds to the insulating element 170 on which the electrically conductive element 160 bears and exerts a pressure corresponding to the axial force Fx.

Figure 9:
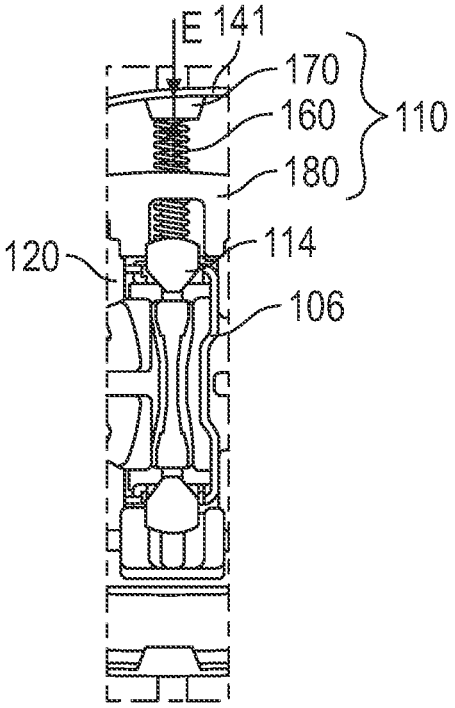
FIG. 9 schematically shows, in elevation from its front face or coupling face, a detail of the connector from FIG. 6.

When the detection device 110 is installed in the connector 100, the support 180 is surrounded in a recess formed in the internal housing element 120 of the connector 100, such that the electrically conductive element 160 is in electrical contact, via one of its axial ends, with the conductive component 106 (and more particularly one of its flexible tabs 114) and is insulated, at the other axial end, from the shielding metal sheet 141 by the insulating element 170 (FIG. 9).

The electrically insulating element 170 is therefore inserted between the electrically conductive element 160 and the shielding metal sheet 141. The thickness E of the electrically insulating element 170 thus inserted is for example between 0.5 millimetres and 2 millimetres. For example, this thickness E is equal to or close to 0.8 millimetres.

Thus, in the event of overheating, that is to say if the temperature in the connector becomes for example greater than or equal to 180° C., the insulating element softens and, under the effect of the pressure exerted by the electrically conductive element 160 on the electrically insulating element 170, the electrically conductive element 160 passes through the electrically insulating element 170 and establishes electrical contact with the shielding metal sheet 141.

It is possible to conceive of other variants of the detection device 110 described above. For example, an electrically insulating element 170 similar to the one described above may be inserted between the electrically conductive element 160 and the conductive component 106. As an alternative, the electrically insulating element 170 is inserted between the electrically conductive element 160 on one side and between the electrically conductive element 160 and the shielding cage 108 on another side.

Likewise, the shielding element may be formed of something other than a metal sheet (for example a housing element on which a conductive layer is deposited).

Likewise, the electrically conductive element may be other than a spring (for example a component that expands under the effect of heat).

The detection device may be installed in the mating connector 200, rather than in the connector 100, or else in the connector 100 and the mating connector 200.

Rather than a connection device 1 that makes it possible to connect two power cables 112, 212 in pairs, the connection device 1 may be designed to connect a single cable or more than two cables.

The connector and mating connector do not necessarily have shielding and/or are not necessarily connected to an interlock control circuit. In this case, the low-voltage lines may be dedicated lines or lines configured so as to transmit a signal.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

The invention claimed is:

1. Electrical connector comprising:

a housing that houses at least one first conductive component configured so as to be integrated in a first low-voltage electrical line and at least one second conductive component configured so as to be integrated in a second low-voltage electrical line, at least one first material forming the housing, at least one electrically insulating element and at least one electrically conductive element, inserted between the first conductive component and the second conductive component, wherein the electrically insulating element consisting of a second material having a melting temperature less than or equal to the melting temperature of the at least one first material, and wherein the electrically conductive element exerting an elastic force on the electrically insulating element that is suitable for deforming the electrically insulating element, when the electrically insulating element has a temperature greater than or equal to its melting temperature and establishing an electrical connection between the first conductive component and the second conductive component.

2. Electrical connector according to claim 1, wherein the first conductive component is configured so as to be connected to an interlock control circuit of a high-voltage circuit by way of the first low-voltage electrical line.

3. Electrical connector according to claim 1, wherein the second conductive component is a shielding element attached to the housing.

4. Electrical connector according to claim 3, wherein the electrically insulating element is inserted between the electrically conductive element and the shielding element.

5. Electrical connector according to claim 1, wherein the electrically insulating element and the electrically conductive element are integrated together in a passive detection device installed in a recess in the housing.

6. Electrical connector according to claim 1, wherein the electrically conductive element exerts a force of between 1 and 50 newtons on the electrically insulating element.

7. Electrical connector according to claim 1, wherein the electrically conductive element is a helical spring compressed between the electrically insulating element and at least one of the first and second conductive components.

8. Connection assembly comprising a connector according to claim 1, and a mating connector comprising a housing that houses signal contacts that are configured so as to be integrated in the first low-voltage electrical line, these signal contacts being connected to the first conductive component when the connector and the mating connector are coupled.

9. Method for detecting overheating in a connection assembly, wherein the deformation of an electrically insulating element made of plastic, under stress from an electrically conductive element, is used to modify an electrical circuit.

10. Method according to claim 9, comprising an operation of collecting a signal by taking a series of electrical measurements on a first low-voltage line, furthermore comprising an operation of monitoring, over time, whether the signal collected in the course of the series of electrical measurements taken on the first low-voltage line undergoes a variation following a connection of the first low-voltage line to a second low-voltage line, this connection being the consequence of the deformation of the electrically insulating element.

11. Method according to claim 10, comprising an operation in which a first conductive component is connected to an interlock control circuit of a high-voltage circuit and the variation of the signal occurs following a connection of the first conductive component to a shielding element of the connector, by way of the electrically conductive element.

* * * * *